US006053280A

United States Patent [19]

Smith et al.

[11] Patent Number: 6,053,280

[45] Date of Patent: Apr. 25, 2000

[54] HANGING SCAFFOLD SUPPORT

[75] Inventors: Fred P. Smith, Alpinie; Kevin L. McAllister, Orem; D. Paul Riley, Lehi, all of Utah

[73] Assignee: Wall Walker, LLC, Orem, Utah

[21] Appl. No.: 09/042,658

[22] Filed: Mar. 17, 1998

[51] Int. Cl.[7] ..... E04G 3/00

[52] U.S. Cl. ..... 182/82; 182/150

[58] Field of Search ..... 182/82, 150

[56] References Cited

U.S. PATENT DOCUMENTS

| | | | |
|---|---|---|---|
| D. 313,853 | 1/1991 | Hutchins | D25/68 |
| D. 318,785 | 8/1991 | Dean | D8/373 |
| 751,359 | 2/1904 | Stronach et al. | 182/150 X |
| 1,558,425 | 10/1925 | Yetter . | |
| 2,121,704 | 6/1938 | Leeworthy | 304/14 |
| 3,322,387 | 5/1967 | Fortin, Sr. | 248/235 |
| 3,510,097 | 5/1970 | McCaleb | 182/150 X |
| 3,595,510 | 7/1971 | Hutchinson | 182/82 X |
| 4,068,446 | 1/1978 | Brueske | 52/747 |
| 4,121,690 | 10/1978 | Rawlings et al. | 182/45 |
| 4,122,916 | 10/1978 | Strobel | 182/82 |
| 4,153,229 | 5/1979 | Bequette | 248/240.3 |
| 4,452,336 | 6/1984 | Sickler | 182/82 |
| 4,497,389 | 2/1985 | Whitlam et al. | 182/150 |
| 4,646,877 | 3/1987 | Whan | 182/38 |
| 4,823,911 | 4/1989 | Dore | 182/119 |
| 4,828,073 | 5/1989 | Friday | 182/36 |
| 4,884,775 | 12/1989 | Fischer, Jr. | 248/237 |
| 4,957,185 | 9/1990 | Courchesne et al. | 182/150 |
| 4,971,169 | 11/1990 | Fruth | 182/119 |
| 4,972,922 | 11/1990 | Levine | 182/45 |
| 5,067,586 | 11/1991 | Myers | 182/45 |
| 5,148,890 | 9/1992 | Sipe | 182/45 |
| 5,259,477 | 11/1993 | Fears et al. | 182/82 |
| 5,332,062 | 7/1994 | Revere | 182/27 |
| 5,503,358 | 4/1996 | Lapp | 182/82 X |
| 5,601,154 | 2/1997 | Eisenmenger | 182/45 |
| 5,678,654 | 10/1997 | Uzawa | 182/150 |
| 5,829,549 | 11/1998 | Flynn | 182/82 |

*Primary Examiner*—Daniel P. Stodola
*Assistant Examiner*—Hugh B. Thompson
*Attorney, Agent, or Firm*—Madson & Metcalf

[57] ABSTRACT

A deck support may be created to hang from a top plate of a wall in residential or other construction. An upright or leg may provide support of the weight of the deck supported on a foot extending laterally from the leg. The foot may be provided with a climber attachment that secures the foot extending horizontally from the leg, and yet is readily adjustable without alignment, line-of-sight adjustment, removal or repositioning of pins, and the like. The apparatus may operate to support a user installing soffits, fascia, trusses and other assemblies near the upper portions of walls at any stage of construction. Adjustment may be done safely by a single user employing a single hand. Alignment and engagement are simple and automatic by the climber securing the foot to the leg. A hanger bracket may extend adjustably across the top plate of a wall to support the leg extending vertically therebelow. The hanger may be opened to release from a wall after construction has been finished around the hanger rendering it otherwise non-removable. The entire assembly may be collapsed, without separation of parts, for transportation and storage.

20 Claims, 9 Drawing Sheets

HANGING SCAFFOLD SUPPORT

BACKGROUND

1. The Field of the Invention

This invention relates to supporting structures for use during construction, and more particularly to novel systems and methods for supporting decking for workmen above ground level in residential or other construction projects similar in nature.

2. The Background Art

Scaffolding has long been of both utility and concern in construction. In many state as well as in federal regulations, detailed specifications of requirements apply to "riggers" and their craft. Scaffolding may be thought of as decking for supporting materiel, workman, tools, and the like, above or below a common surface.

For example, a workman may stand on the ground while laying brick, working on certain woodwork, while wiring, and so forth. In construction of large, multi-storied buildings, special decking may be laid specifically for use during construction. Many feet above ground level, scaffolding built from the ground up becomes impractical. However, scaffolding may be used within a few stories' distance of the ground.

Scaffolding presents several problems. To provide proper structural strength, scaffolding is typically quite heavy. Moreover, special riggers' licensing may be required for use of scaffolding. In residential construction, the commitment of time and manpower for setting up and taking down scaffolding support may represent a substantial fraction of the task for which such scaffolding is set up in the first place.

Ladders are limited in their utility. Ladders must be moved frequently. Ladders may not be positionable readily both inside and outside the envelope of a building at all stages of construction where scaffolding may be useful or required. The weight, bulk, manpower, lack of flexibility in application, awkwardness in working indoors or in semi-finished areas, and the like add to the difficulty and expense of using conventional scaffolding.

What is needed is a simplified system for supporting workmen, tools, and materials, a distance above ground level suitable to facilitate several common tasks. For example, decking suitable for working near a top plate of a residential construction wall is necessary. A support for decking positionable to support a workman installing soffits, fascia, installing trusses, and working on other projects that cannot readily be reached from the ground, is needed.

A support system is needed that is easily portable. A system that can be set up and taken down in a minimum amount of time, while occupying a minimum of space during storage and transport is needed. Such a system capable of extending over a substantial working area upon deployment is needed. Likewise needed is a system that can be set up by a single workman. Adjustability in height, length, distance from a bearing wall and the like are preferable.

Preferably, such a system can hang from a top plate. It should adjust to a variety of widths of top plates. Simple removal from the top plate after closure of soffits, sheathing, and the like about walls and ceilings would be very useful.

A system is needed that does not require significant penetrations into a structure, and which can be used both interior and exterior to a bearing wall of a house. A system that could be used even when a building in initial stages of framing, and yet during stages of semi-finished condition inside or outside a wall, would be beneficial. A system is needed that is easily operable (e.g. adjustable, carriable, deployable, etc.) with a single hand, or by a single user.

What is needed is a deck or scaffold support that can be climbed readily by some support mechanism in order to quickly adjust the height of a deck. A system that is fail safe, such as being non-separable during adjustment, does not require multiple hands or adjustment, does not require precision alignments by a user, does not require eyes of a user to be located in a difficult position for adjustment, and does not require dismantling or removal in order to be adjusted, would be extremely efficient.

A system that provides for plank positioning close to and distanced from a wall, selectively at the choice of a user is needed. A system that can be collapsible or ready-storage and transport with a minimum of fitting and assembly for use would be extremely handy and efficient in use of manpower.

A deck or scaffold support is needed that provides simple adjustment of deck positions vertically and operational adjustment horizontally. The ability to work on open walls comprised merely of studs, or to work on closed walls, and even perhaps to work on partially bricked walls, would be preferred.

BRIEF SUMMARY AND OBJECTS OF THE INVENTION

In view of the foregoing, it is a primary object of the present invention to provide a method and apparatus for creating, maintaining, and adjusting a scaffold or deck above ground level for supporting workmen, tools and materials.

It is an object of the invention to provide simple, portable support systems that can be easily set up by an individual.

It is an object of the invention to provide a support system that will hang from a top plate of a residential construction project, such as a bearing wall.

It is an object of the invention to provide a scaffolding support system that will adjust to multiple top plates and be removable therefrom after construction has been substantially closed in either interior or exterior to a wall from which the support mechanism is suspended.

It is an object of the invention to provide a system that may be supported substantially without penetrations to the structure.

It is an object of the invention to provide a climber mechanism for simple adjustment of height without intervention by the eyes of a user for removal of fittings, or installation of pins and similar mechanisms in precise locations requiring alignment, and without generally allowing free separation of mating parts.

It is an object of the invention to provide a fail safe supporting system for eliminating slippage, multiple hands, multiple workmen, or structural separation of parts during adjustment.

It is an object of the invention to provide non-separating parts, automatic adjustment and catching of a deck support at multiple locations along a supporting upright leg, all with one handed operation by a single user.

It is an object of the invention to provide a supporting mechanism for plank positioning horizontally, selectively closer or farther from a subject wall.

It is an object of the invention to provide a deck support mechanism that is collapsible and easily and simply dismantled with a minimum of motion, for convenient storage and transport occupying a minimal envelope in bulk, with a minimum of weight, while yet providing adequate safety, simplicity, and stability in deployment and operation.

Consistent with the foregoing objects, and in accordance with the invention as embodied and broadly described herein, an apparatus and method are disclosed, for certain embodiments of an invention including a leg extending in a more-or-less vertical or upright direction and provided with a lateral foot extendable therefrom. The lateral foot may be connected to the leg by a climber mechanism that supports the foot in operation, while simply and safely disengaging and readjusting the height of the foot along the leg.

In one embodiment, an apparatus and method in accordance with the invention may provide a railing support secured, opposite the leg, to the foot in order to prevent falls by workmen from the deck extending across the foot. Multiple units may be deployed to support each end of decking materials. Likewise, decking materials of substantial lengths may be supported at their respective end and middle portions by multiple units of the apparatus. Decking may be extended beyond the standard length of a particular decking material by interleaving or overlapping decking across multiple pairs of apparatus deployed along a wall.

The support system may include railing supports that are removable or collapsible for storage, after a railing itself is removed. Railing may be provided from simple construction materials readily available at any work site. Thus, the system may be completely collapsible into a comparatively small envelope containing the leg and foot, and optionally the leg, foot, and railing support, in a single package, completely interconnected and not disconnected at any point.

In one embodiment, no pieces of the apparatus may be completely separated from other pieces without full intent, application of appropriate tools, and the like. Thus, the system may be fully adjustable with single-hand operation by a single user, while remaining failsafe.

In certain preferred embodiments, no pins, precision adjustments, alignments, or the like are required for height adjustments by a user. Instead, all the parts involved are self-aligning. The foot may comprise a climber that is both self-aligning, self-capturing, and rigidly locked against failure in a loaded direction. By contrast, the same system may be readily collapsible into a unit of three elongated pieces, including a leg, foot, and railing support positioned substantially in parallel and fully connected, pivotably, in a dismantled (with respect to decking and railing) mode.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIGS. 3 and 4 are rear quarter, perspective views of a collapsible support mechanism for a railing post in a deployed, and collapsed position, respectively, illustrating alternative mechanism for pivoting, stopping, locking, and the like;

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, is not intended to limit the scope of the invention. The scope of the invention is as broad as claimed herein. The illustrations are merely representative of certain, presently preferred embodiments of the invention. Presently preferred embodiments of the invention will be best understood by reference to the drawings, wherein like parts are designated by like numerals throughout.

Figure 1:
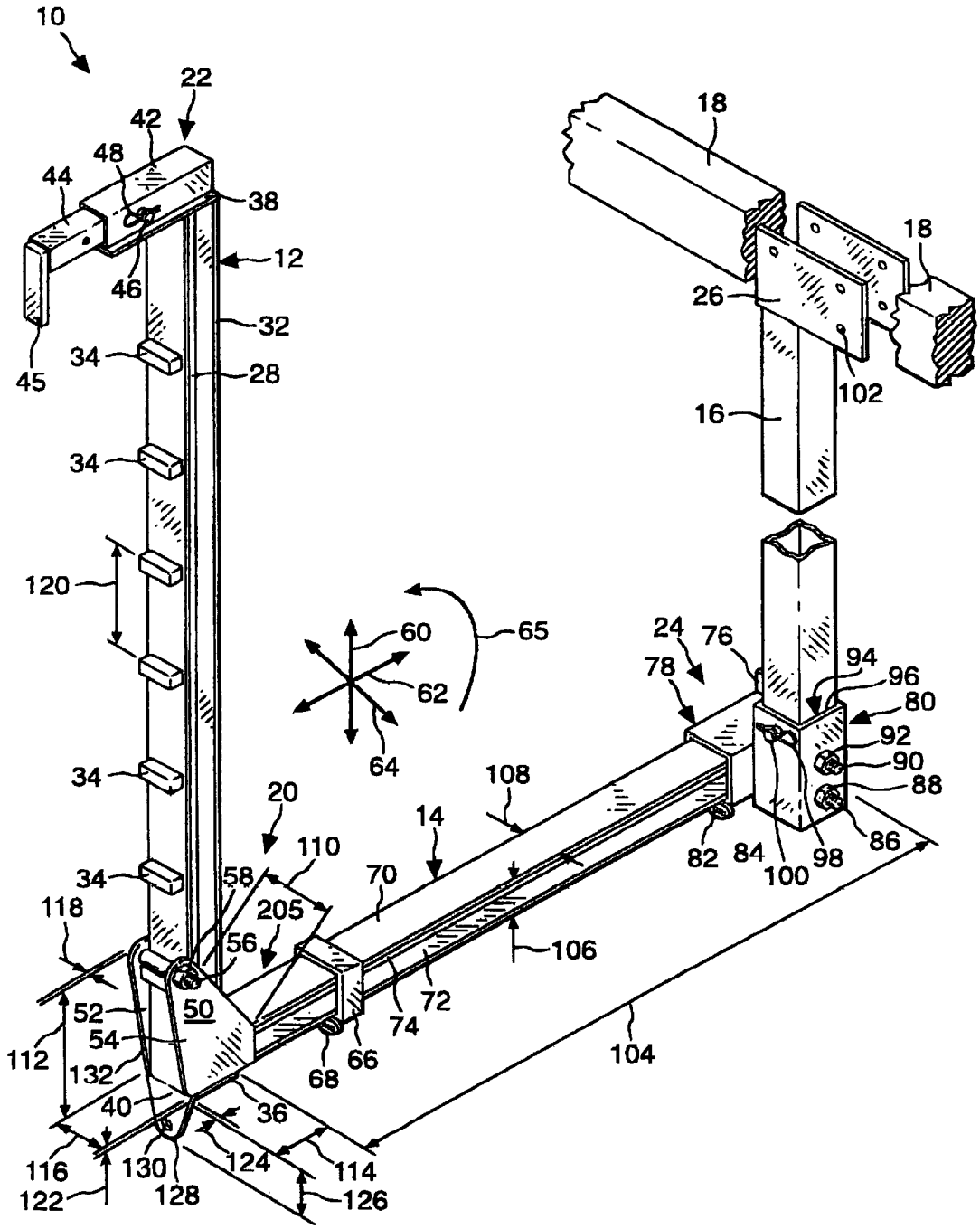
FIG. 1 is a rear quarter perspective view of one embodiment of an apparatus implementing various features of the invention.

Referring to FIG. 1, and apparatus 10 or support system 10 may be formed to have a leg 12 or an upright 12. The leg 12 provides vertical extension for positioning a deck 13 which may be comprised of wooden planks such as 2×12 boards, specialized decking materials, or the like.

The leg 12 may be formed of an I-beam member or a channel, and may even be tubular, whether circular in cross-section or rectangular in cross-section. Moreover, the leg 12 need not have a uniform cross-section, but may be designed to support loadings in different directions differently.

A foot 14 may extend from the 12, being secured thereto as a lateral member 14 extending away from a wall of interest supporting the leg 12. The foot 14 may be secured to the leg 12 to be easily adjustable, preferably by a single hand of a single user. Moreover, the foot 14 may be configured to be easily adjustable without requiring alignment, and to automatically secure to the leg 12 at the first available opportunity if dropped by a user during adjustment. The foot 14 may be adjustable by more than a single step in one motion. Thus, adjustability may be extremely rapid, and adjustability may extend over substantial distances in a single movement.

A riser 16 may be provided as a post 16 for supporting a rail 18 or a railing. The rail 18 may be formed of regular construction materials or may be provided from a specialty material. In general, construction materials may be used temporarily for a railing 18, and be removed for use in construction later. Thus, standard studs or planks may be used as rails 18 supported by the riser 16 or post 16 and secured thereto. Alternatively, specialty materials may be created of metals or other materials to be attachable and removable from securement to the riser 16.

In one presently preferred embodiment, a connector 20 may be provided as a connection mechanism 20 for securing the foot 14 to the leg 12 at a desired position. Thus, the connector 20 may be designed as an independent mechanism attachable to the foot 14 or the leg 12. In one presently preferred embodiment, the connector 20 may be welded or otherwise fixedly attached to the foot 14, thus preventing any failures of fastening mechanisms that may loosen with time, or be improperly installed.

Figure 2:
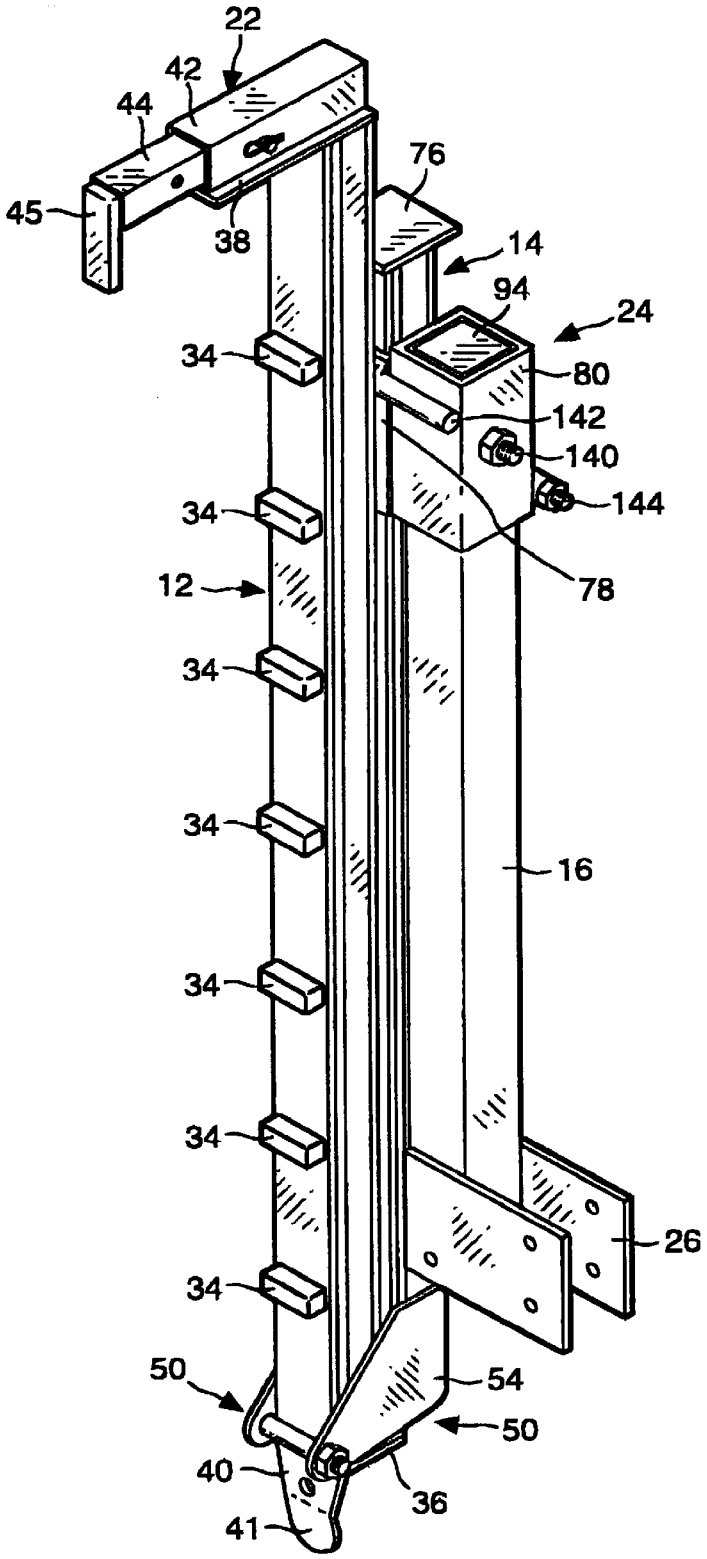
FIG. 2 is a rear quarter, perspective view of the apparatus of FIG. 1 illustrating certain particular alternative embodiments of selected features such as a collapsible support for a railing post, and laterally extended hangers for the climber.

Referring to FIG. 2, and continuing to refer to FIG. 1, a hanger 22 may be secured to one end of the leg 12. The hanger 22 may be adjustable for different sizes of top plates in a construction project. Similarly, a base 24 may be secured or securable to the foot 14, and may be thought of as forming a portion of the entire foot 14 assembly. The base 24 may support the riser 16 in a manner to render adjustable the riser 16 to a desired position, with respect to the leg 12, along the foot 14.

A bracket 26 may be provided for securing the rail 18 to the post 16 or riser 16. The bracket 26 may be fastened by any suitable means to the post 16. Nevertheless, welding may be used in certain preferred embodiments to assure that assembly, installation, security, and reliability remain high.

Inasmuch as the apparatus 10 is designed as a safety mechanism for operating above ground level, minimization of maintenance may be important. Accordingly, the bracket 26 may be bolted to the post 16, welded, or secured by other fasteners including slots, locks, pins, and the like, deemed suitable for proper support of a railing 18 and securement thereof to the post 16. The post 16 may be removed from the base 24 and nested between the flanges 30, 32 or the flanges 70, 72 for storage. An appropriate fastener may secure the post 16 there, for storage or for working in situations for which the railing 18 is inappropriate. For example, work in close quarters, near foundation holes close to outside walls, or indoors, in hallways, etc., may not be appropriate for use of a railing 18.

The leg 12 may include a web 28 and flanges 30, 32. In the embodiment illustrated in FIGS. 1–2, an I-beam construction is contemplated. Nevertheless, webs 28, and flanges 30 may be configured in a variety of shapes, including a common channel, boxed tube, or circular tubing. Nevertheless, in one embodiment, the web 28 is equivalent to a wall 28, while each flange 30, 32 is equivalent to a wall. Accordingly, an I-beam construction requires only three walls covering the same space that four walls would cover in a rectangular tubular configuration. Thus, virtually equivalent strength at the outermost fiber of each of the flanges 30, 32 is available, without the additional weight of a tubular construction.

The leg 12 may be provided with stops 34 or blocks 34 secured thereto. The stops 34 may be positioned at regular or irregular intervals. For example, in certain construction projects, the foot 14 may be profitably positionable at specific locations. Accordingly, stops 34 may not need to be installed at every position. For example, operation of a workman on decking 13 on the foot 14 at a maximum distance from the hanger 22 may be important.

Alternatively, positioning the decking 13 at a location as close to the hanger 22 as possible may provide access to the top plate by a workman. Intermediate thereto, the stops 34 may be positioned for standard tasks readily required at particular heights. Examples may include attachment of fascia and soffits. Likewise, a particular height may be suitable for installing trusses extending over top plates. Thus, stops 34 may be provided for those particular positions. Nevertheless, in one embodiment, the stops 34 may be distributed at uniform distances, such as two inches apart, four inches apart, six inches apart, or the like.

A security stop 36 may be provided at the bottom end of the leg 12. The security stop 36 may be thought of as an end plate. Nevertheless, the security stop 36 need not be a plate. In certain embodiments, the end stop 36 or security stop 36 may be a rod, a bar, or the like. In general, the security stop 36 may prevent passage of the connector 20 and the foot 14 beyond the end of the leg 12. Whether the security stop 36 is welded, bolted, riveted, fastened removably or fastened permanently may be determined as a design selection balancing strength, safety, manufacturing, and other considerations.

A mounting plate 38 may be secured to the leg 12. In certain embodiments, some may consider the leg 12 to include all parts pertaining thereto and not secured directly to the connector 20 or the foot 14. The mounting plate 38 may structurally stiffen the end of the leg 12 in order to receiver the hanger 22.

Opposite the hanger 22 may be positioned a stabilizer 40. The stabilizer 40 may be formed as a plate secured to the security stop 36 of the leg 12 or the flange 30. A stabilizer 40 may protect against transverse motion by the foot 14. In certain embodiments, the stabilizer 40 may be securable to the wall from which the apparatus 10 hangs.

For example, a nail through the stabilizer 40 or spur 40 may provide great stability with minimum effort and minimum effect on the structure of the wall to which secured. In one embodiment, the stabilizer 40 may be flared. A flare 41 may angle under the leg to point away from the wall sufficiently to be engaged by a hammer claw, pry bar, or other lever. Levers for which the flare 41 may be designed may include a wood scrap of common dimension, or other tool likely to be available at a construction site.

The foot 14 is connected to the leg 12, which hangs from the hanger 22. Decking 13 positioned on the foot 14 need not be secured thereto. Thus, although the leg 12 itself may stabilize the apparatus 10 against a wall from which it hangs, the stabilizer 40 may secure the leg 12 against movement along the wall. Thus, the stabilizer 40 may be nailed to a wall, or may have other mechanisms such as spikes, plates, bumpers, grippers, and the like for minimizing motion of the leg 12 with respect to a wall. For example, geometry and position of the stabilizer 40 may be such that even when a nail is used, the connector 20 may still operate behind the leg 12. The connector 20 may be designed to so operate. In another embodiment, the connector 20 may be positioned in contact against the wall, requiring movement away from the wall for adjustment of height. In each embodiment forces are shared between the leg 12 and connector 20 differently.

Returning to the hanger 22, a housing 42 may be secured directly to the leg 12 or fastened to a mounting plate 38. A housing 42 may be provided with a slide 44 fitted thereto. The slide 44 is movable with respect to the housing 42 for adjusting the hanger 22 according to a width of a top plate from which the apparatus 10 is to hang. A finger 45 may be secured at an end of the slide 44. Accordingly, the finger 45 and the leg 12 will capture between them the top plate or other surface. The surface may be on top of a structure such as a wall, foundation, fence, rafter, or the like, all referred to herein as the "wall."

The top surface may be horizontal, typically, but need only be substantially horizontal. That is, the hanger should not slide along transversely 64 with respect to the wall or surface unintentionally. Two copies of the apparatus 10 may be set at two separate heights of blocks 34 along their respective legs, with nails through the slide 44 into the surface to preclude transverse sliding along a surface that is tilted from horizontal. Thus, stability and safety must be accommodated, but substantially horizontal may be thought of as providing the majority of support longitudinally 60 directly from the wall (e.g. structure) to the hanger 22, with sufficient transverse 64 support to safely prevent slipping.

In one embodiment, the slide 44 may be secured to the housing 42 by a lock 46. The lock 46 may be a pin 46, provided with a keeper 48 such as a lynch pin 48. The lynch pin 48 may be tethered for safekeeping. For additional security, the finger 45 may be bent toward the leg 12 to fit under a top plate. Thus, in one embodiment, the finger 45 may even be bent to return parallel to the slide 44.

Nevertheless, gravity is typically sufficient to maintain the leg 12 in position, supported by the hanger 22 with a straight finger 45. The finger 45 may support a substantial couple created by a load on the deck 13 and foot 14, in conjunction with the support to the hanger 22. The couple is transferred to the finger 45 and connector 20 or other member touching the wall.

A climber 50 may be provided as part of, or the entire, connector 20. The climber 50 is designed to be secure under the load presented by the foot 14. For example, a balance of forces, even with the weight of the foot 14 alone is sufficient to position the climber 50 securely against the first available block 34. In certain embodiments binding may occur with a minimal block 34, and even with none at all. However, to prevent free-falling from an unloaded position (e.g. such as from a bouncing load), block 34 may be relied upon.

The climber 50 will provide simple adjustability of the foot 14 upward or downward. A simple tilting of the foot 14 counter to the load applied to or by the deck 13 will free the climber 50 from a block 34, so the leg 14 may be lifted higher to another block 34. The specific geometry of the climber 50 provides both secure attachment, positioning, and adjustability of the foot 14 with respect to the leg 12.

The climber 50 may contain multiple hangers 52, 54 such as the plates 52, 54. In addition, a catch 56 may extend between the hangers 52, 54. The catch 56 may be a bolt 56 secured by a nut 58. In one currently preferred embodiment, the nut 58 be a lock nut, such as a crown nut 58 provided with a nylon, friction-producing member to eliminate vibration or accidental removal of the nut 58. Other locking mechanisms may be available. In one embodiment, the catch 56 may be a rod welded permanently to the hangers 52, 54 to form the climber 50.

The climber 50 may move in a longitudinal direction 60 with respect to the leg 12. The climber 50, and particularly the hangers 52, 54 support the weight and moment of the deck 13, through the foot 14, in a longitudinal direction 60. The climber 50 also supports the foot 14 in a lateral direction, the foot 14 thus extending away from a wall supporting the leg 12.

Likewise, the hangers 52, 54, or plates 52, 54, in conjunction with the catch 56 may be slidably positioned along the leg 12 to resist motions (e.g. translation, rotation) in a transverse 64 direction. Thus, longitudinal 60, lateral 62, and transverse 64 directions may be referred to in describing the functionality, forces, and operation of the apparatus 10, and of the foot 14 and riser 16 with respect to the leg 12.

In addition, a circumferential direction 65 may be described with respect to any pivot point. For example, a circumferential direction 65 may be described with respect to the contact point (e.g. 205, see FIGS. 9–10) between the foot 14 and the leg 12 or with respect to the catch 56. Similarly, a circumferential direction 65 may be described with respect to any rotation of a component of the apparatus 10.

Regarding the deck 13, a positioner 66 or slide 66 may be provided to position decking materials 13 along the foot 14. For example, a user may desire space for working between the decking 13 and a wall supporting the leg 12. Accordingly, the positioner 66 may restrain decking 13 toward a distal end of the foot 14 away from the climber 50. The positioner 66 may be provided with a lock 68. The lock 68 may be designed to operate in a variety of manners. For example, a thumb screw, latch, pin, cam lock, or the like may be used for rapid or slow, distinct or continuous, convenient or inconvenient adjustment, for a variety of reasons.

In general, the flanges 70, 72 of the foot 14 may be connected by a single web 74. Alternatively, as discussed with respect to the leg 12, a different cross-section may be selected for the foot 14. As a practical matter, the outermost fibers of the flanges 70, 72 support the bending moment applied to the foot 14 by loads to the decking 13. Unless buckling failure becomes a significant design concern, the web 74 is sufficient for maintaining both position, load, and tolerating loading deflection.

Nevertheless, a tubular cross-section, whether rectangular, square, circular, or the like may be provided for the foot 14. In one presently preferred embodiment, reduced weight may be provided by a single web 74 extending between a pair of flanges 70, 74. Due to the nature of the bending loads on the foot 14 when personnel and material are positioned on the decking 13, double flanges 70,72 may be recommended.

A retainer 76 may form an end stop 76 on the foot 14. Accordingly, the retainer 76 may prevent movement of the base 24 beyond the end of the foot 14. In one embodiment, the retainer 76 or plate 76 may be welded or otherwise permanently secured to the flanges 70, 72 and web 74 of the foot 14. In other embodiments, the retainer 76 may be secured to be removable, such as by use of a clamp, set screw, bolt, rivet, or the like.

The base 24 may also contain a positioner 78 for positioning the base 24 along the foot 14. In one embodiment, the positioner 78 may also provide other functional features. For example, the retainer 66 or positioner 66 need not be particularly robust. On the other hand, protection and support of a user against a railing 18 may preclude use of a small positioner 78. Thus, the positioner 78 may be effectively designed to have sufficient bearing length in a lateral direction 62 for providing stability and structural integrity for all functions thereof The positioner 78 may be secured movably, fixedly, pivotably, rotatably, or the like, with respect to a receiver 80. The receiver 80 may be adapted to receive the riser 16 supporting the railing 18. In one embodiment, the receiver 80 may be welded to the positioner 78. A lock 82 may secure the positioner 78 at a position longitudinally 62 (laterally 62 with respect to the leg 12) along the foot 14.

The lock 82 may be designed to operate in any suitable manner. For example, a cam lock, a thumb screw, a pin, a spring-loaded detent, or the like may be used.

The wall 84 of the positioner 78 may be designed to support substantial loads. The railing 18 and the riser 16 may form a security device against falls, leaning, and the like of workers operating on the decking 13. Accordingly, the longitudinal 62 dimension of the positioner 78 may be designed to support such loads, whether representing a static or impact loading condition.

In certain embodiments, a bolt 86 secured by a nut 88 may fasten the receiver to the positioner 78. Likewise, a second bolt 90 and nut 92 may be provided. In one embodiment, either of the bolts 86, 90 may actually form a pivot, with the other bolt 90, 86 providing a lock. Thus, removal of one of the bolts may provide collapsibility of the riser 16 by rotation (pivoting) of the receiver 80 with respect to the positioner 78.

An aperture 94 may be provided for receiving the end 96 of the riser 16. In one embodiment, a keeper 98 such as a lynch pin 98 may secure a retainer 100, pin 100 or the like, extending through the receiver 80 and riser 16. Similarly, a bolt 86 may be provided in place of the pin 100. Likewise, in one embodiment, the bolt 90 may provide a pivot, while a pin 100 is used in place of the bolt 86. Thereby, a bolt 86 may be used in position of the pin 100.

The receiver 80 may be quickly unpinned and pivoted about the bolt 90 to a position parallel to that of the positioner 78. Accordingly, the riser 16 may be positioned more-or-less parallel to and beside both the foot 14 and the leg 12, without removal from the base 24, when in a completely collapsed position (see FIG. 2).

The bracket 26 may be provided with apertures 102 for receiving nails, screws, and the like penetrating into the railing 18. Accordingly, the rail 18 may be secured from removal during use. For collapse of the receiver 80 to position the riser 16 alongside the foot 14, the nails or screws may be removed from the aperture 102, and the railing 18 may be removed.

In one embodiment, a length 104 of a foot 14 may extend two or even three feet from the leg 12. Meanwhile the depth 106 of the foot 14 may be designed to accommodate the bending loads consistent with the length 104. For example, stress in the flanges 70,72 is substantially increased by positioning a user at a comparatively long length 104 from the leg 12. Support of a heavy user at the full length 104, such as positioned near the riser 16 and leaning against the riser 16, may require an increased depth 106.

The width 108 of the flanges 70, 72 may be increased for increased loads. However, as a practical matter, the stress within the flanges 70, 72 is affected directly by the width 108 but to a third power of the depth 106. Accordingly, for a particularly long length 104, comparatively, an increase in depth 106 may be preferable, for a weight and cost criteria for a foot 14.

In securing and adjusting the foot 14 with respect to the leg 12, a clearance 110 may be provided between the catch 56 and the foot 14. For example, the height 112, and length 114 of each of the plates 52, 54 (hangers 52,54) may be designed to provide a clearance 110 on a diagonal with respect to the foot 14. Accordingly, lifting the foot 14 tends to tilt (pivot) the foot 14 in a circumferential direction 65 and climber 50 with respect to the leg 12.

Accordingly, the catch 56 will rotate circumferentially 65 away from the blocks 34 and leg 12. Thus, the clearance 110, when positioned to extend in a substantially lateral direction 62, with respect to the leg 12, may provide sufficient clearance for the catch 56 to pass by a block 34 as the foot 14 is moved up or down (longitudinally 60) the leg 12. When the foot 14 is released, the flanges 70,72 rotate counter to the upward circumferential direction 65 bringing the catch 56 into contact with the flange 30 and a block 34.

The catch 56 and foot 14, along with the climber 50 may slide down in a longitudinal direction 60 from any position of release until being stopped by the next available block 34. However, if a user rotates the foot 14 in a circumferential direction 65, then the foot 14 may be translated in a longitudinal direction 60 upwardly or downwardly before being released. Thus, a simple lifting motion can adjust the position of the foot 14. A user may require only a single hand positioned somewhere near the middle of the foot 14 in order to adjust the position of the foot 14 and the catch 56 with respect to the leg 12.

The height 112, length 114, width 116, and thickness 118 selected for the climber 50 may be determined by both structural strength requirements and operational requirements such as the clearance 110. Similarly, free motion, with stability in a transverse direction 64 may be provided by close tolerances between the plates 52, 54 and the leg 12.

The pitch 120 of the blocks 34 may be selected to be regular or irregular. In one embodiment, the pitch 120 may be uniform between blocks 34. In alternative embodiments, selected positions for blocks 34 may effectively provide irregular pitch designed for specific locations of the foot 14 suitable for certain tasks by users.

The thickness 122 of the bottom plate 36 or security stop 36 may be designed to survive an impact load of a drop onto a loaded foot 14. However, the foot 14, when loaded, cannot escape a block 34. In one presently preferred embodiment, the security stop 36 may be a plate, although bars, rods, and the like may be used. A security stop 36 may be welded to the leg 12. Since the catch 56 may be bolted, such a construction may provide manufacturing assembly and repair disassembly with less safety risk.

For example, bolted fastening of the security plate 36 represents an additional risk if such a bolting mechanism were to be loosed, corroded, over-tightened, or the like. Accordingly, in one presently preferred embodiment, the security stop 36 may be welded directly to the leg 12. Similarly, the thickness 124 of the spur 40 or stabilizer 40 may be designed to support loading in a transverse direction 64.

In certain embodiments, different tools or attachments may be secured to the stabilizer 40 or spur 40. For example, in working on brick, a user may desire to position a large wooden plate on the spur 40, in order to minimize pressure against previously laid brick and mortar that has not securely set, or to extend to previously set brick.

In another embodiment, a spike may be attached to slightly penetrate wall sheathing, thus preventing motion. In another embodiment, near the vertex 128 near the maximum depth 126 of the spur 40, an aperture 130 or other fixative 130 may be provided for reducing, resisting, or eliminating movement in a transverse direction 64.

In one embodiment, the edges 132 of the plates 52, 54 may resist motion in a transverse direction 64. In another embodiment, the aperture 130 may be provided with a bolt, or multiple apertures 130 may be provided with fasteners suitable for securing a plate extending below the plates 50, 52. Thus, a plate parallel to the stabilizer 40 and extending therebelow, may secure the leg 12 against loading in both longitudinal 60 and transverse 64 directions as a result of activities and loads on the decking 13.

Referring to FIGS. 2–5, portions of the apparatus 10 of FIG. 1 are illustrated in embodiments provided with geometries and assemblies for promoting collapsible storage and transport. In operation, an apparatus 10 may be shipped as illustrated in FIG. 2. Simple retainers, such as straps, elastic bands, wires, and the like may be used to secure the leg 12, foot 14, and riser 16 in relative positions.

The brackets 26 may be built offset from the riser 16 in order to provide clearance between the riser 16 and the foot 14. In one embodiment, the positioner 66 and positioner 78 may have dimensions suitable for providing clearance between the riser 16 and the positioner 66, as well as clearance with respect to the catch 56 and plate 54.

A user may release the members 12, 14, 16 to move with respect to one another. Accordingly, the foot 14 may be pivoted counter to a circumferential direction 65, thus dropping the end plate 76 or end stop 76 clockwise away from the leg 12. The climber 50 will thus pivot the catch 56 upward about a center of rotation defined by a proximate end of the foot 14.

The slide 44 may be extended from the housing 42 a distance suitable for fitting over a top plate. The slide 44 may be secured by the lock 46 to snug the finger 45 as close as is practical to the top plate.

The spur 40 or stabilizer 40 may be secured against sheathing, a stud, or the like to resist transverse 64 motion. The riser 16 may then be pivoted circumferentially 65 to lift the bracket 26 into position for receiving a rail 18. The receiver 80 may be locked into place with respect to the positioner 78.

The positioner 78 may be slid along the foot 14 to a suitable position and locked, using the lock 82. Similarly, decking 13 may be positioned on the foot 14 by the positioner 66 snugging the decking 13 against the positioner 78. The lock 68 may be used to fix the positioner 66 with respect to the foot 14. The rail 18 may be positioned within the bracket 26 and secured by fasteners throughout the apertures 102.

The apparatus 10 may be collapsed for storage by the reverse procedure. The fasteners may be removed from the apertures 102 so the rail 18 may be removed. Thereafter, the riser 16 may be removed from the receiver 80, or the receiver 80 may simply be rotated with respect to the positioner 78 to become parallel to the foot 14. Thereafter, the foot 14 may be pivoted in a circumferential direction 65 to a position parallel to the leg 12. The entire assembly may be wired, strapped, or otherwise restrained to remain in a bundle.

Referring to FIGS. 1–5, and more particularly to FIGS. 2–5, the pivoting mechanisms of the apparatus 10 may be designed in a variety of configurations. In one presently preferred embodiment, a pivot 140 may be provided as a pin, rivet, shaft, or the like. The pivot 140 may be positioned at any appropriate location with respect to the positioner 78 and receiver 80.

Figure 3:
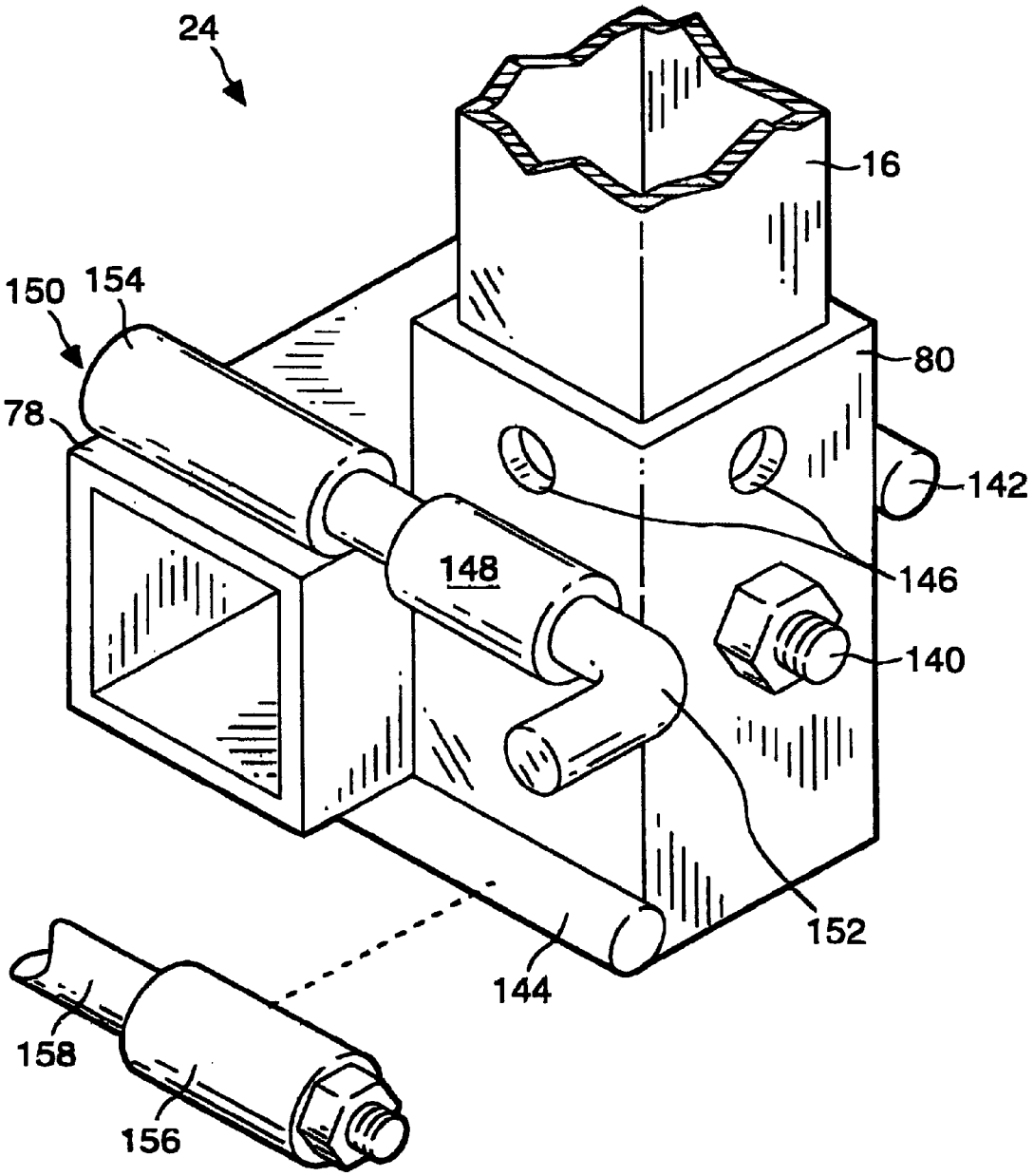

In one presently preferred embodiment, the pivot 140 may be centrally located with respect to both the positioner 78 and the receiver 80. In another alternative embodiment, the pivot 140 may actually be positioned as one of the extensions 142, 144. In another embodiment, the pivot 140 may be positioned as illustrated in FIG. 3, with the extensions 142, 144 being designed to act as a service stop 142, and a storage stop 144.

In one embodiment, the storage stop 144 may be positioned to actually serve as a second service stop 142. That is, the receiver 80 may rotate about the pivot 140 in a circumferential direction 65. In an extended or service position in which the riser 16 extends in a longitudinal direction 60 with respect to the leg 12, the receiver 80 is stopped against the service stop 142 and the service stop or storage stop 144, as well.

By proper selection of dimensions, the service stop 142 may also act as a storage stop. For example, when the receiver 80 is rotated or pivoted down to be positioned parallel to the positioner 78, the extensions 142, 144 both may be positioned to engage or stop rotation of the receiver 80 above the pivot 140.

The apertures 146 may be used to receive bolts, fasteners, or the like, such as the pin 100 illustrated in FIG. 1. In one embodiment, a sleeve 148 may be provided as part of a lock 150. The lock 150 may include a pin 152 or slide 152 operating within a sleeve 148. The slide 152 may be restrained from removal from the sleeve 148. Accordingly, once the receiver 80 is rotated about the pivot 140 to stop against the stops 142, 144 the slide 152 may be aligned with another sleeve 154 secured fixedly to the poisoner 78. Thus, a quick and already aligned motion of the slide 152 into the sleeve 154 can lock the receiver 80.

One may note that the cross-sections of the sleeves 148, 154, slide 152, and stops 142, 144 may be rectangular, square, round, tubular, hollow, solid, or the like, according to need. As a practical matter, the stops 144 may be provided with sleeves 156 on shafts 158. The sleeves 156 may be elastomeric, providing a certain resilience and buffering of loads, thus reducing the probability of bending, fracturing, etc. the stops 142, 144.

In another embodiment, the sleeve 156 may be provided of steel, and may be fixed to the receiver 80. Accordingly, the extension 144 may actually be comprised of a sleeve 156 and shaft 158, where the shaft 158 is secured fixedly, such as by welding to the positioner 78.

Likewise, the extension 142 may be comprised of a sleeve 156 and shaft 158, where the shaft 158 is welded or otherwise securely fastened to the positioner 78, and the sleeve 156 is fixed to the receiver 80. Accordingly, the pivot 140 may be manufactured in place of the extension 144 or the extension 142. Nevertheless, in one presently preferred embodiment, the pivot 140 is located as illustrated in FIG. 3, with simple shafts 142, 144 serving as the stops 142, 144.

A detent, such as a shaft, key, or ball, driven by a spring to extend from an aperture within the slide 152, or the like, may be used to secure the pin 152 from removal out of the sleeve 148, and to restrain the slide 152 against simple removal (e.g. by bumping, vibrating) from the sleeve 154.

An advantage of the apparatus illustrated in FIG. 3 is the lack of alignment required by a user. All alignments may be secured, along with tolerances for meeting alignment criteria by the factory manufacturing the apparatus 10.

Figure 4:
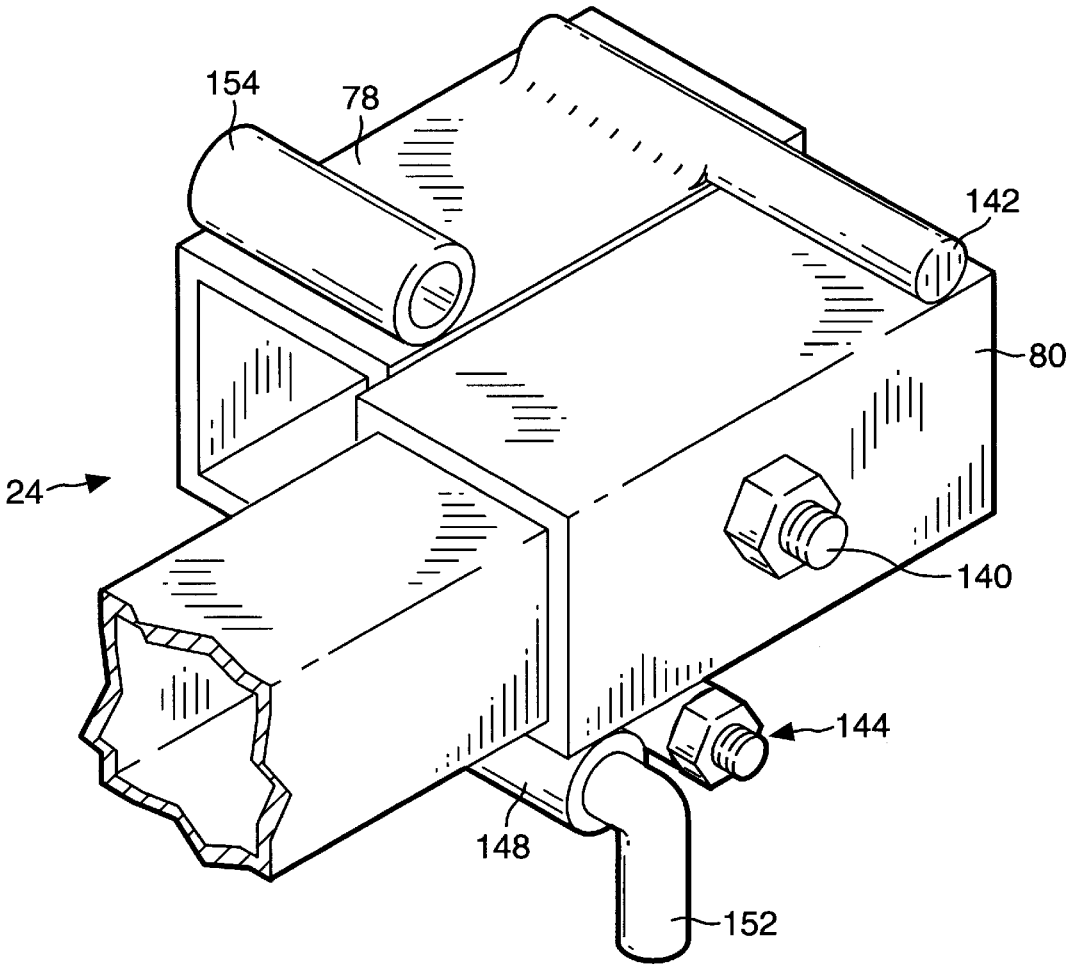
Figure 5:
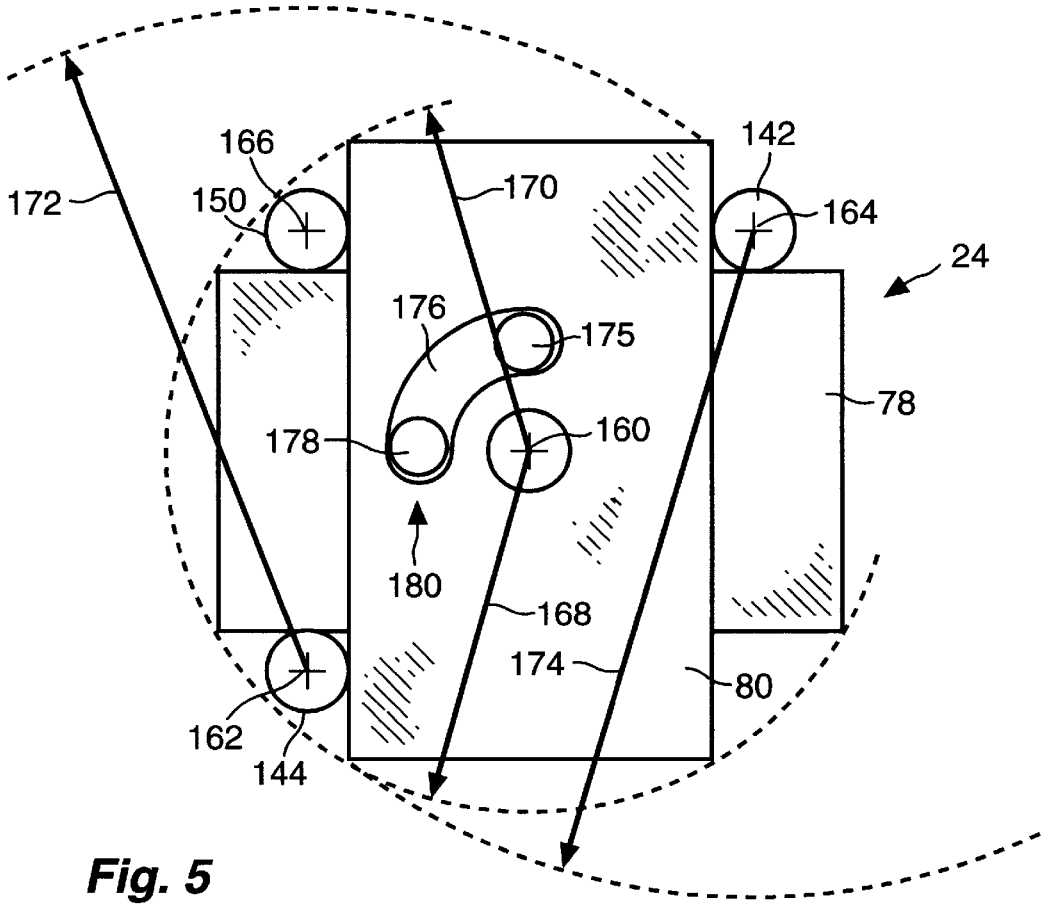
FIG. 5 is a schematic, side elevation view of the envelope of various optional elements of a pedestal or post mount for the apparatus of FIGS. 1–4.

Referring to FIG. 4, the receiver 80 may be pivoted to a storage position. The geometry of the base 24 may position the sleeve 148 in any of several positions with respect to the stop 144. Leverage of the various stops 142, 144 and sleeves 148, 154 against the receiver 80 and positioner 78 may be designed to support the expected Referring to FIG. 5, a geometry is illustrated for positioning the receiver 80 with respect to the positioner 78. Several centers 160, 162, 164, 166 of rotation are illustrated. Likewise, several radii 168, 170, 172, 174 of various points on the base 24 are illustrated. The pivot 140 may have a center 160 causing a radius 168 of curvature for a corner or outermost extremity of the receiver 80 to rotate in an arc. Thus, the centers 162, 164 of the respective stops 144, 142 may be designed to engage the receiver 80 within the radius 168. Similarly, the lock 150 may be positioned at a center 166 within a radius 170 for engaging the receiver 80 securely.

In one embodiment, a ball 175 or pin 175 may be spring-loaded and positioned to operate within a race 176 between a depression 178 below the ball 175. Thus, a detent 180 may be created for provided some nominal amount of force for retaining the receiver 80 in a deployed, or a collapsed condition as desired. Thus, the detent 180 may prevent the receiver 80 from moving while a user effects securement of the lock 150.

Figure 6:
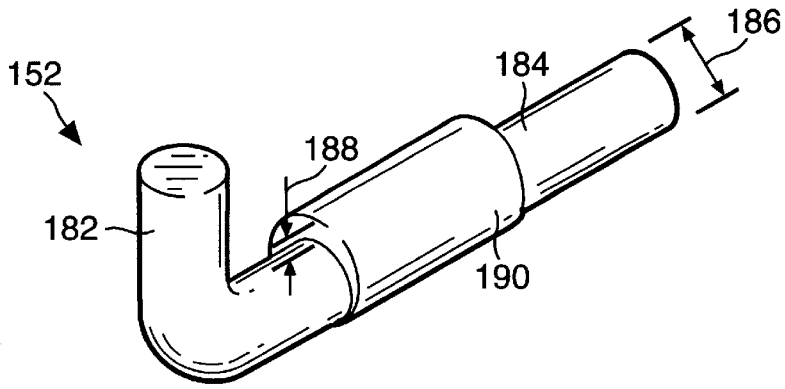
FIG. 6 is a perspective view of one embodiment of a lock, relying on an eccentric or cam.

Referring to FIG. 6, any lock 68, 82, 150 may use a cam, lever, or other suitable mechanism. For example, in FIG. 6, a slide 152 is illustrated having a lever 182 or handle 182 secured for rotating a shaft 184 or spindle 184. The diameter 186 of the shaft 184 may be selected for suitable strength in operation within the sleeves 148, 154 or the like.

However, an offset 188 may be provided in an eccentric 190. Accordingly, the lever 182 may be used to rotate the shaft 184 in order to engage the eccentric 190 against a surface. Thus, for example, the eccentric 190 could be moved into an elliptical sleeve 154 (see FIG. 4) and the cam 190 may be used to secure the shaft 184 against being moved. Similarly, eccentrics 190 or cams 190 may be used to pass completely through a sleeve 154, and rotate to a position of engagement with a tooth, stud, or the like.

Figure 7:
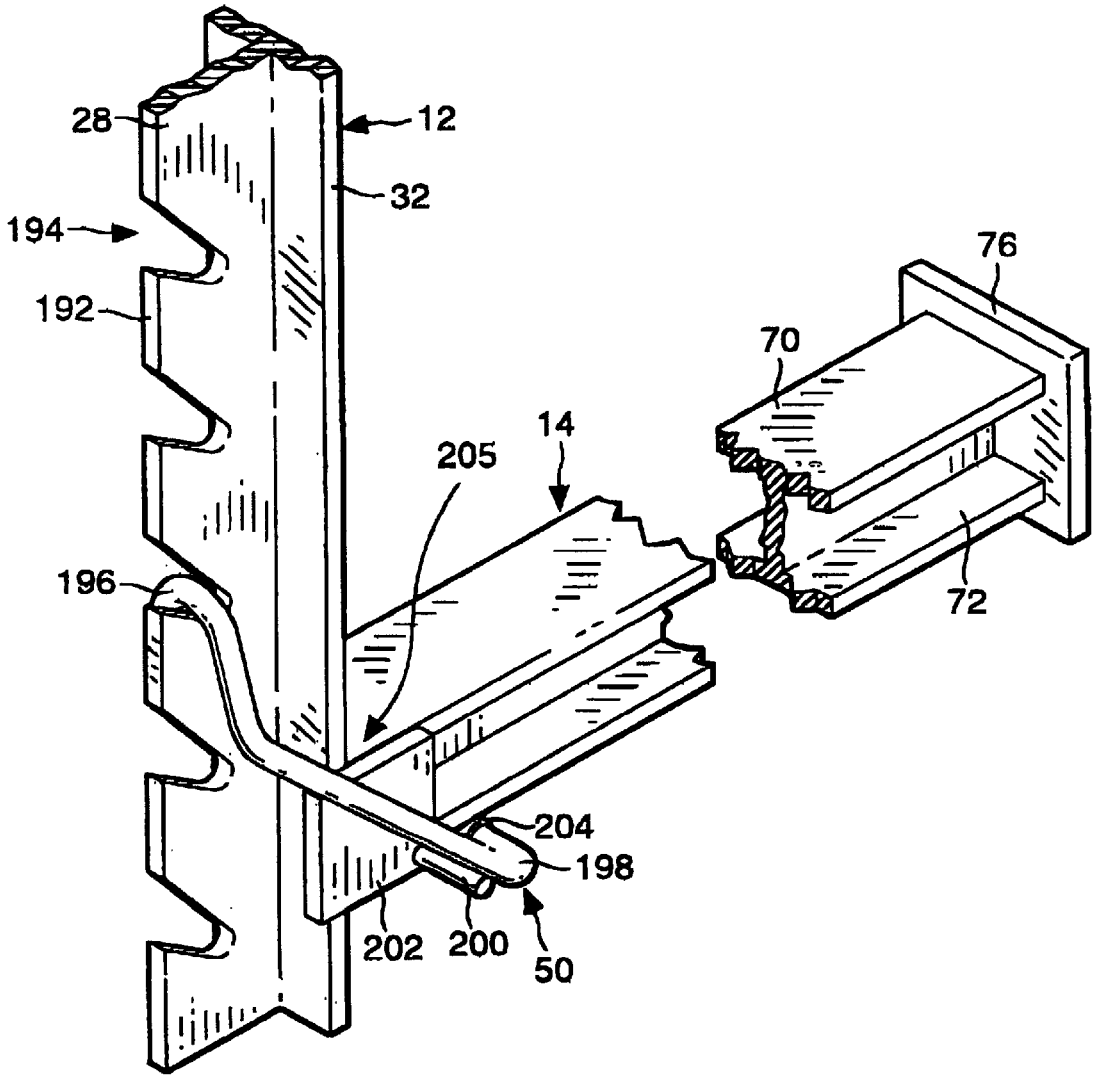
FIG. 7, is a rear quarter, perspective, cut-away view of a portion of an alternative embodiment of an apparatus in accordance with the invention, relying on certain alternative structural members for various functions, as compared the apparatus of FIGS. 1–2.

Referring to FIG. 7, an alternate embodiment of an apparatus 10 in accordance with the invention is illustrated. In the embodiment of FIG. 7, the foot 14 is illustrated in a cutaway view having the positioners 66, 76 removed. The climber 50 is formed of bar or rod stock rather than the assembly illustrated in FIG. 1. The web 28 is formed with a single flange 32. Thus, a T-shaped cross-section is used to form the leg 12.

The web 28 is fabricated to contain alternating buttresses 192 below notches 194 or seats 194 adapted to receive a hanger 196 of a climber 50. The climber 50, in addition to the hanger portion 196 may be formed to have a shaft portion 198 extending transversely 64 under the foot 14.

In one embodiment, a stop 200 may extend from an attachment to the foot 14, or from a rider 202. The rider 202 may serve the same purpose on each side of the leg 12 as would the plates 52, 54 (see FIGS. 1–2). Nevertheless, the riders 202 primarily limit twisting of the foot 14, and support against transverse 64 motioned by the foot 14. Thus, the shaft portion 198 of the climber 50 may rotate in a bushing 204 or sleeve 204 secured, such as by welding, to the underside of the foot 14.

The security stop 36 and the stabilizer 40 may be formed in any suitable manner to operate with the leg 12. Similarly, the end stop 76 may be provided on the foot 14 in any suitable manner.

In the embodiment of FIG. 7, the leg 14 may be pivoted in a circumferential direction 65 by elevating the end stop 76 above the riders 202. Accordingly, the bushing 204 is rotated closer to the buttresses 192 and notches 194. Thus, the foot 14 will rotate about the proximate end 205 attached to the riders 202. The riders 202 are free, with respect to the leg 12, to slide up and down 60 with the foot 14. The riders 202 may typically be welded to the foot 14, and may be strengthened further with doublers (additional plates) between the flanges 70, 72.

As the foot 14 is rotated about its proximate end 205, the bushing 204 will move the shaft portion 198 closer to the buttresses 192, while the shaft portion 198 rotates with respect to the bushing 204. Accordingly, the hanger portion 196 will be pushed out of the slot 194 or notch 194.

Once the hanger portion 196 has moved out of the slot 194, it may tend to drop, rotating within the bushing 204. Therefore, the stop 200 may extend transversely 64 underneath the climber 50 in order to limit downward rotation. Accordingly, thus restrained, the climber 50 may be drawn (translated) with the foot 14 upward 60 or downward 60 along the leg 12 with the foot 14. Thus, when the foot 14 is released and counter-rotated circumferentially 65 back into its laterally extending position, the bushing 204 draws the hanger portion 196 back into the next available notch 194 in the web 28.

In the embodiment of FIG. 7, the rear flange 30 is absent. The rear flange 30, when used, is subject to a compression component, and the flange 32 a tension component from the bending moment presented by a load applied to the decking 13 over the foot 14. A tensile component of load in the web 28 and flange 32 comes from the weight applied to the foot 14. Accordingly, where buckling is not a realist consideration, a web 28 may not require a flange 30 opposite the flange 32. By any means, the principle of a foot 14 connected by a climber 50 to a leg 12 operates similarly, because of a clearance 110 between a proximate end 205 of a foot 14, and a catch 56, such as the hanger portion 196 that is selectively caught on a block 34 or buttress 192 of the leg 12. Nevertheless, in certain respects, the embodiment of FIG. 1 may tend to operate more rigidly, whereas, by comparison, the embodiment of FIG. 7 tends to operate in reliance on suspension.

Figure 8:
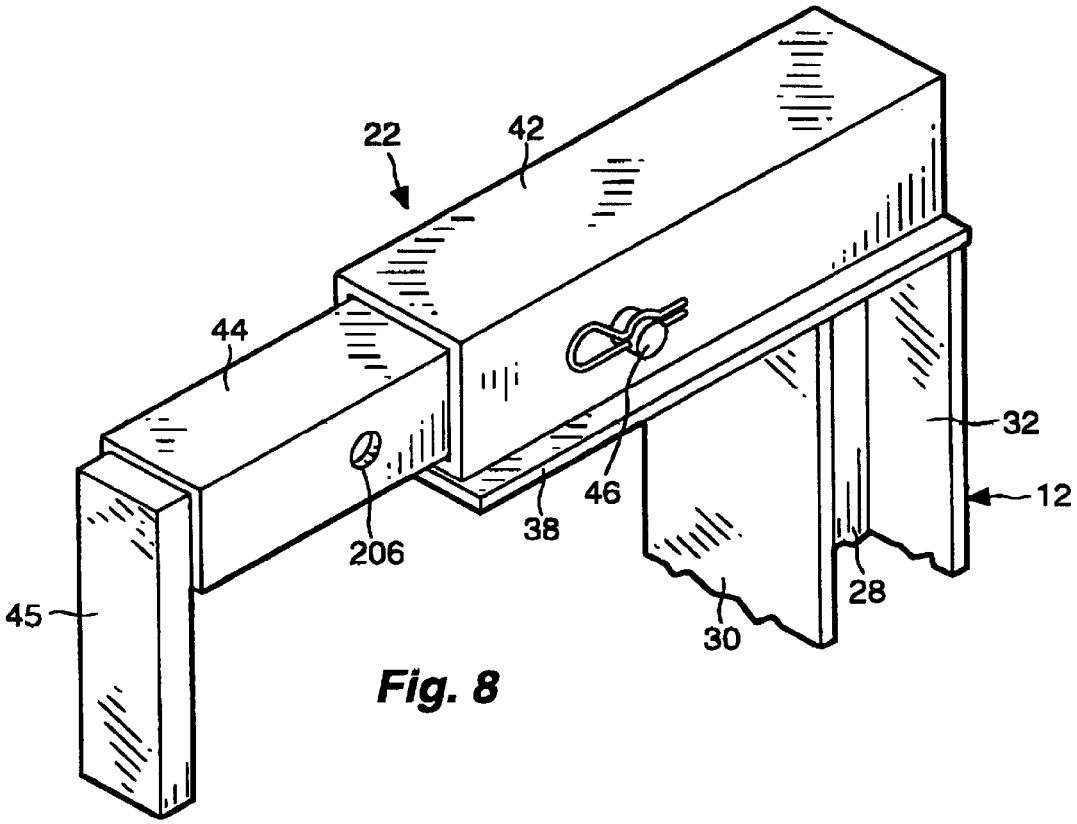
FIG. 8 is a rear quarter, perspective view of an adjustment head for extending across a top plate from the leg of an apparatus of FIGS. 1–7.

Referring to FIG. 8, the hanger 22 at the top end of the leg 12 may be adapted to fit over any suitable top plate in a construction wall. The housing 42 may be provided with a lock 46 such as a pin 46 as hereinbefore described. Accordingly, the lock 46 may be removed and the slide adjusted to extend from the housing 42 an appropriate distance required for the leg 12 and finger 45 to clear or span the opposite sides of the top plate.

The pin 46 may be removed for adjusting the slide 44 with respect to the housing 42. Thus, the pin 46 may be removed from the apertures 206 and reinserted where needed. In one embodiment, the mounting plate 38 may be dispensed with in favor of a tubular cross-section for the housing 42. Thus, the housing 42 may be welded directly to the flanges 30, 32 and web 28.

Additional features and functions of the hanger 22 may be derived from complete and selective separability of the slide 44 from the housing 42. In one embodiment, the slide 44 may be sufficiently long to extend completely through the housing 42. Likewise, the slide 44 may be removed from the back end of the housing 42 into which it is inserted for operation. Thus, upon completion of a project in the area of the hanger 22, the hanger 22 can be dismantled. Thereby, the housing 42 may be removed from one side of a wall while the slide 44 is removed from the other. In this manner, the hanger 22 may be fit into a space or over a top plate that will eventually be closed in. Nevertheless, the hanger 22 may be dismantled for simple removal, despite the large and other wise awkward geometry that may be presented.

In certain embodiments, the slide 44 may be removed, re-inserted, and locked into the front of the housing 42. The finger 45 may thus extend down over a folded (collapsed) foot 14, near the end stop 76. The foot 14 may be moved along the leg 12 to facilitate capture of the foot 14 (e.g. end stop 76) by the finger 45. Thereby, the finger 45 may serve as a detent for maintaining the apparatus in a comparatively small envelope for storage, without additional parts, fasteners, and the like.

In one alternative embodiment, the post 16 may be removed from the base 24 and nested in the leg 12 or foot 14, between the flanges 30, 32 or flanges 70–72, respectively. A clip, retainer, bracket, detent, or other capture mechanism may retain the post for storage and transport. In certain situations, the railing 18 and post 16 may not be appropriate. For example, indoors in a hallway, outdoors between a foundation and the wall of the excavation, hanging from rafters, disposition of a very short deck with short distances between two units 10, etc. may preclude clearance or obviate the need for the railing 18. For example, three or more of the apparatus 10 arranged on alternating sizes of a deck 13 may suspend the deck 13 from rafters. Positioning the foot 14 at a comparatively high elevation above the security stop 36 may preclude use of the railing 18.

Figure 9:
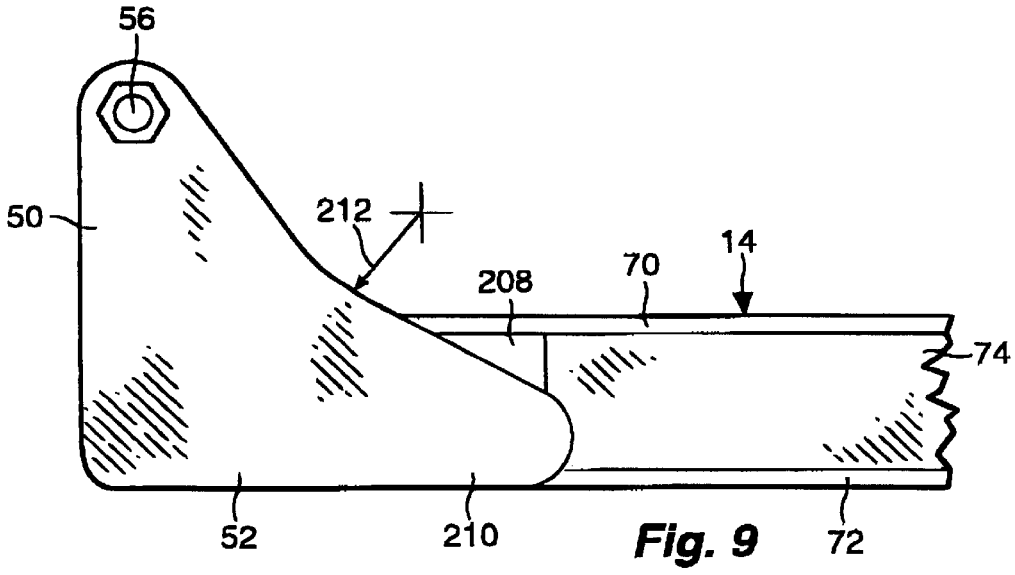
FIGS. 9 and 10 are side elevation views of alternative embodiments for a climber of FIGS. 1–2 securing a leg to a foot in accordance with the invention.
Figure 10:
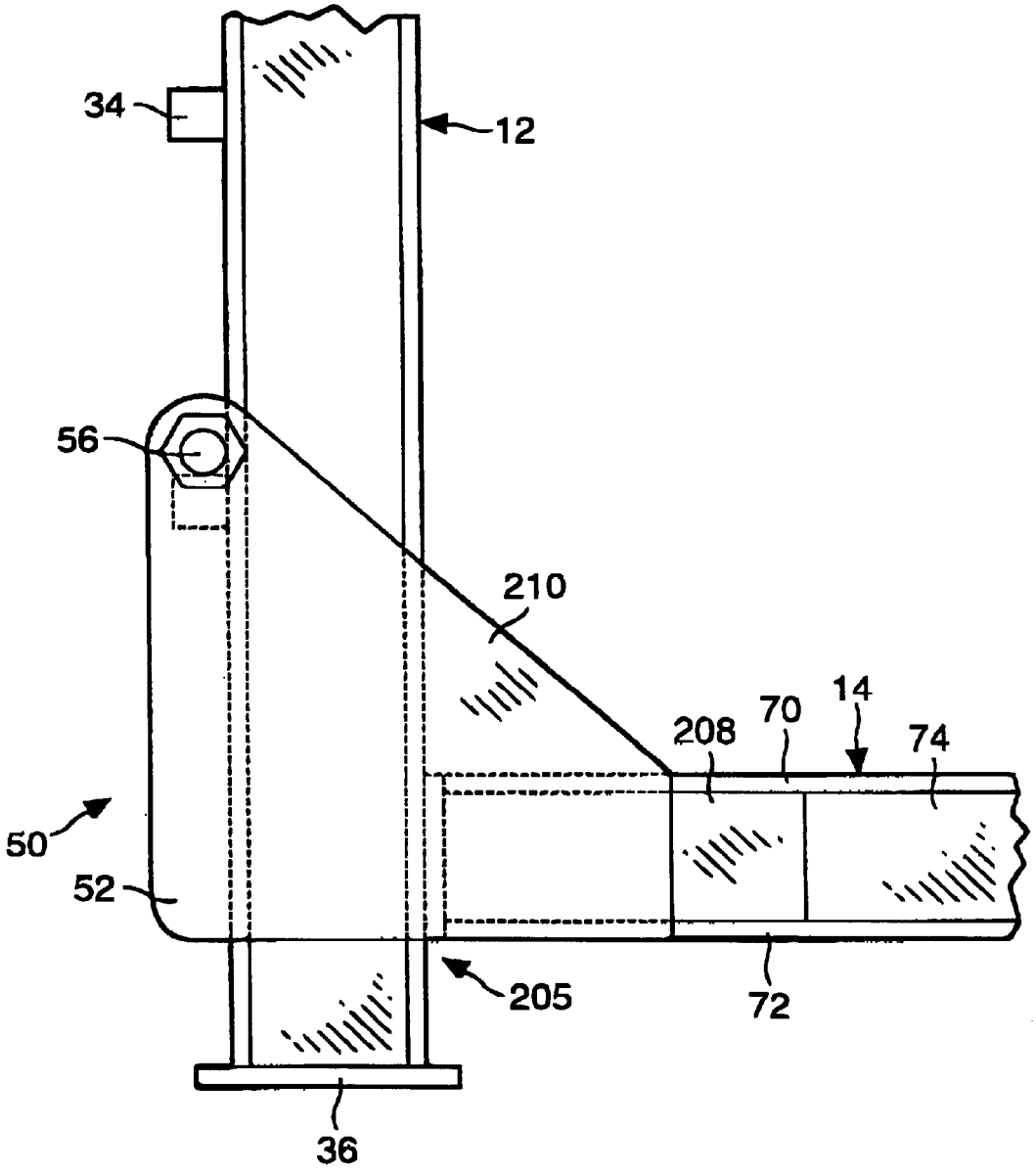

Referring to FIGS. 9–10, alternative embodiments of the plates 52, 54 are illustrated. In the embodiment of FIG. 9, the climber 50 may be provided with a gusset portion 210 on the plate 52. The gusset portion 210 may extend further along the foot 14, while still providing substantial clearance for the decking 13 along the top flange 70. Accordingly, loads may be supported by several additional improvements. For example, a doubler 208 may be formed of an additional plate positioned between the flanges 70, 72 further connecting the plate 52, 54 to the foot 14. Thus, a doubler 208 may be welded to the flanges 70, 72 and the plates 52, 54 may be welded to the doubler 208. Likewise, stress-relieving, malleable welds may secure the flanges 70, 72 between the plates 52, 54.

In one embodiment, the plates 52, 54 may be provided with a radius of curvature 212 for distributing and reducing stress. Fracture toughness and stress concentration factors can be substantial in articles having dramatic changes in cross-section. Accordingly, a radius of curvature 212 may relieve stress concentration factors that would otherwise debilitate the structural integrity of the plates 52, 54. To reduce or eliminate stresses or a stress concentration at a sharp corner, the plates 52, 54 may be secured to the doublers 208 and to the flange 72, at any appropriate location. Meanwhile, the plates 52, 54 may be secured to the flange 70 only away from the radius of curvature of 212. Accordingly, the upper edges of the plates 52, 54 may be free to relieve stress concentrations that would otherwise occur at a joint or sharp change in section.

The embodiment of FIG. 10 illustrates a doubler 208 shown in visible and hidden lines between the flanges 70, 72. The doubler 208 extends back to an end 205 of the foot 14, and may attach to an end plate 214. The end plate 214 may provide additional strength, as well as bearing surface for lubrication against the leg 12. Thus, the flanges 70, 72 may provide less binding and receive less damage from impact loads of handling.

The gusset portion 210 of the plates 52, 54 in the embodiment of FIG. 10 may not provide clearance (such as the radius of curvature 212) for decking 13 to be placed substantially against the leg 12. The additional capacity for loading may be provided by the gusset plate 210 extending to the foot 14 at a position away from the leg 12. This may justify a lack of proximity or access to the leg 12, and the increased moment created by positioning the decking 13 farther away from the leg 12. The catch 56 and the blocks 34 operate exactly the same as illustrated in FIGS. 1–2. Similarly, the security stop 36 operates as hereinbefore described.

Figure 11:
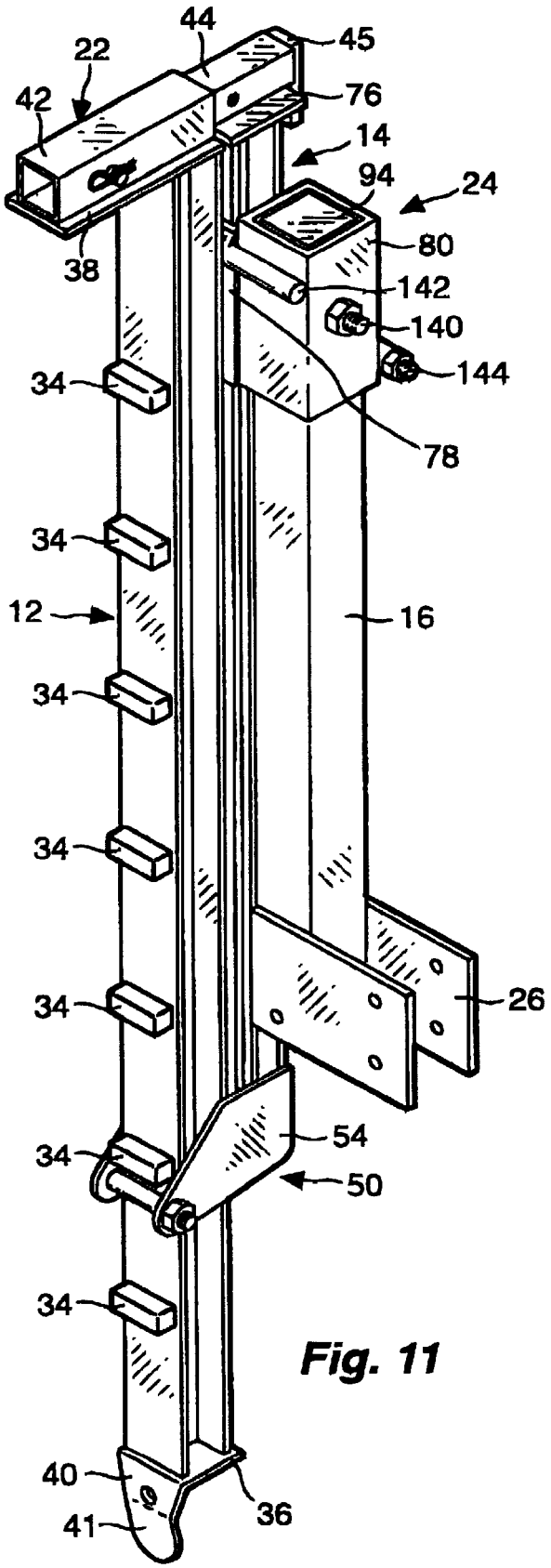
FIG. 11 is a rear quarter perspective view of an apparatus in accordance with the invention, collapsed and retained for storage and transport.

Referring to FIG. 11, certain alternative embodiments of features are illustrated in accordance with the invention. For example, the flare 41 of the stabilizer 40, the latching assembly of the hanger 22 for storage, with the foot adjusted to be captured thereby, and the alternative pivoting mechanisms and stops (e.g. consistently and selectively designed as members 140, 142, 144), are illustrated as described hereinbefore.

One may see from FIGS. 1–11 that the invention provides a leg 12 suspended from a hanger 22 that may be fitted to a top plate or other surface of a construction wall or other similar, substantially horizontal structure. The leg 12 may be gripped by a climber 50 supporting a foot 14 for extending laterally 62 therefrom. The foot 14 may be provided with positioners 66, 78 for locating decking 13 at a desired proximity to the leg 12.

Similarly, the positioner 78 can support a receiver 80 from which a riser 16 may extend to hold a railing 18 for additional security. The riser 16 and receiver 80 may pivot down from a locked or deployed position to lie parallel to the foot 14 in a storage position. The foot 14 may be rotated about a proximate end 205 of the foot 14 to release the catch 56 from the blocks 34. Accordingly, the foot 14 may be laid approximately parallel to and against the frontal flange 32 of the leg 12. Accordingly, the leg 12 with the foot folded thereagainst, and the riser 16, absent its railing 18, folded therebeside, may form a small package of three substantially parallel members 12, 14, 16 for simple securement, transport, and storage. Alternatively, the post 16 may be removed from the base 24 and nested between the flanges 30, 32 or the flanges 70, 72, being maintained by any appropriate fastener, for storage or for working in situations for which the railing 18 is inappropriate. Any or all of the alternative embodiments of the apparatus 10 or any individual component thereof may be used alone, in combination, or deleted, in any consistent design approach to implementing a desired embodiment of the invention herein described.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus comprising:

a leg having first and second ends and extending substantially vertically for supporting a load;

a hanger secured proximate the first end for securing the leg to hang from a top surface of a substantially horizontal member;

a foot connected between the first and second ends to extend away from the leg, to be supported thereby, for supporting a deck disposed thereon; and a climber adjustably securing the foot to the leg, the climber being selectively movable continually capturing the leg to limit relative motion therebetween, and being self-aligning and self-lockable with respect to the leg.

2. The apparatus of claim 1, further comprising a base, securable to the foot and spaced from the leg, for supporting a post extending therefrom and a railing extending transversely with respect to the post, leg, and foot.

3. The apparatus of claim 2, wherein the foot and climber are pivotable with respect to the leg to effect selectively moving and locking with respect to the leg.

4. The apparatus of claim 2, wherein the base further comprises a positioner and a receiver, pivotable with respect to one another for collapsing the post to a position substantially parallel to the foot.

5. The apparatus of claim 1, wherein the climber is pivotable with respect to the leg between a deployed position extending laterally therefrom, and a storage position substantially parallel thereto.

6. The apparatus of claim 5, wherein the climber is pivotable between the deployed position and the storage position directly, while maintaining rigid body motion with respect to the leg.

7. The apparatus of claim 1, wherein the climber is self-releasing upon tilting of the foot upwardly.

8. The apparatus of claim 1, wherein the foot is positionable along the leg by a single hand of a user.

9. The apparatus of claim 8, wherein the climber is self-aligning upon deployment, with respect to the leg, upon release by a user.

10. The apparatus of claim 9 wherein the climber and leg are self-engaging with respect to one another upon release of the climber by a user.

11. The apparatus of claim 1, wherein the climber is formed to provide a stress-concentration relief region proximate the foot for resisting fracture of the foot, climber, and connections therebetween.

12. The apparatus of claim 1, further comprising a positioner securable to the foot for positioning decking in a lateral direction along the foot.

13. The apparatus of claim 1, wherein the leg is substantially monolithic.

14. The apparatus of claim 13, wherein the climber is configured to selectively lock at an arbitrary position, selected by a user, along the leg.

15. The apparatus of claim 1, further comprising a stabilizer for resisting transverse motion of the leg along the structure.

16. The apparatus of claim 15, wherein the stabilizer is configured to resist transverse motion, and to position the leg to facilitate movement and adjustment of the climber longitudinally along the leg.

17. An apparatus for supporting a deck to provide access by workmen to a supporting structure under construction, the apparatus comprising:

a first member disposed to hang longitudinally from a supporting structure;

a second member movably secured, proximate a proximal end thereof, to extend laterally away from the first member;

a third member secured to position the second member with respect to the first member; and the third member, further adapted to be self-aligning between the first and second members, to maintain the first member captured in a manner continually limiting relative longitudinal and lateral motion between the first and second members.

18. The apparatus of claim 17, wherein the third member aligns the second member and captures the first member securely to the second member upon release of the second member by a user during adjustment.

19. A method for supporting a worker on a deck proximate a substantially horizontal member of a construction, the method comprising:

hanging a first member to extend longitudinally from a substantially horizontal member of a construction;

deploying a second member to extend laterally in a deployed position, with respect to the first member, for supporting a deck thereon, the second member being substantially, downwardly immovable in the longitudinal direction with respect to the first member; and tilting the second member with respect to the first member to release the second member from immobility, the second member continually maintaining capture of the first member to limit longitudinal and lateral movement thereof with respect to the first member;

selectively positioning the second member longitudinally with respect to the first member;

releasing, by the user, the second member, and self-aligning and self-locking by the second member with respect to the first member.

20. An apparatus for supporting a deck, the apparatus comprising:

a leg for supporting the apparatus;

a foot extending laterally with respect to the leg, and substantially orthogonally to the longitudinal direction of a structure;

the foot selectively positionable in a substantially vertical direction along the leg, while continually maintaining the leg captured in a self-aligning, self-locking arrangment effective to continually limit horizontal and vertical motion of the foot with respect to the leg and; and a hanger for selectively stabilizing the leg with respect to the structure; and the hanger, further comprising an adapter effective to adjust a dimension of the hanger to fit an arbitrary dimension, corresponding thereto, of the structure.

* * * * *